United States Patent [19]

Criswell

[11] 3,974,613

[45] Aug. 17, 1976

[54] CURTAIN WALL GASKET

[76] Inventor: Homer C. Criswell, 2608 Black Oak Lane, Arlington, Tex. 76012

[22] Filed: Oct. 17, 1972

[21] Appl. No.: 298,309

[52] U.S. Cl. ..... 52/400; 52/403; 49/493

[51] Int. Cl.[2] ..... E04B 1/62; E06B 3/62

[58] Field of Search ..... 52/403, 402, 393, 235, 52/400, 489, 493, 499, 498, 495; 49/489, 480, 481, 482, 487, 499, 493

[56] References Cited

UNITED STATES PATENTS

| | | | |
|---|---|---|---|
| 2,612,972 | 10/1952 | Heimgartner | 52/400 |
| 2,655,239 | 10/1953 | Kenlock | 52/400 |
| 3,699,735 | 10/1972 | Smith | 52/403 |

*Primary Examiner*—John E. Murtagh
*Attorney, Agent, or Firm*—Jack A. Kanz

[57] ABSTRACT

Disclosed is a curtain wall gasket adapted to support inside wall glazing materials. The gasket includes an expansion zipper which acts as the support and attachment means for attaching the gasket to support mullions.

5 Claims, 1 Drawing Figure

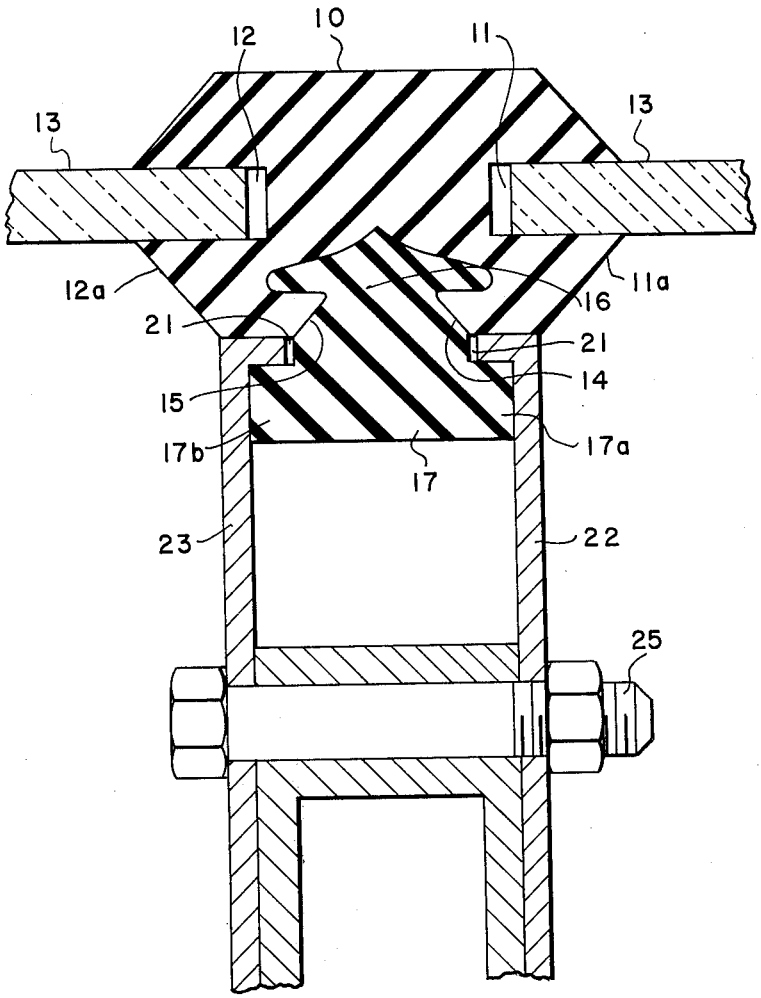
10
12
11
13
13
12a
11a
16
21
21
14
15
17b
17a
17
23
22
25

CURTAIN WALL GASKET

This invention relates to curtain wall construction. More particularly it relates to an improved structural gasket for inside curtain wall glazing employing an integrated locking wedge and support.

Rubber gaskets are conventionally employed for retaining curtain wall panels within an open space defined by structural framework. The panel usually has separate panel framing elements attached to one face of the structure framework. The panels are ordinarily made of glass or other rigid materials. The framework is generally composed of a number of extruded metal members joined to form a single module having grooves defined therein for retaining an elastomeric gasket. The gasket contains grooves running along the length thereof for insertion of the curtain wall panel. Ordinarily the gasket strip includes a wedge-shaped member insertable in a wedge-receiving recess in the strip opposite the mounting support whereby the elastomeric material is crowded to cause the groove to engage the glass or other rigid sheets more securely. Such gasket strips have become widely used for external glazing to form non-structural curtain walls.

In conventional systems the gasket is ordinarily T-shaped in cross-section; the base of the T providing a tongue for insertion into a mullion for supporting the gasket and panel. The grooves for receiving the panels are normal to the tongue and the wedge is opposite the tongue. Accordingly, the gasket must be secured to the mullion framework before the panels are inserted. The panels are then inserted into the panel-receiving grooves and the wedge thereafter forced into the gasket. It is sometimes, however, difficult to properly position the panels within the gasket after the gaskets are secured in the mullions.

In accordance with the present invention a gasket system particularly suitable for inside wall glazing is provided which employes a gasket having grooves running the length thereof adapted to receive the glass or other rigid sheet. The gasket also contains a wedge-receiving groove and a wedge adapted to mate with the wedge-receiving groove. The wedge extends from the gasket and is provided with an expanded lip spaced from the gasket body to define grooves between the wedge lip and the gasket body running parallel to the grooves for receiving the glazing material. Oppositely disposed L-shaped mullions are adapted to mate with the grooves between the gasket body and the wedge lip, thereby providing support for the gasket system. Accordingly, the entire glazing curtain, comprising panel, gasket and expanding wedge may be assembled before the panel is erected. The assembled wall panel may then be positioned as desired and mounted by means of a special mullion comprising oppositely disposed L-shaped bodies adapted to mate with the grooves between the gasket and the lip on the wedge. The assembly may thus be more easily erected than conventional glazing. Furthermore, the expansion wedge is completely hidden from view; rendering the invention particularly advantageous for inside floor-to-ceiling glazing. Other features and advantages of the invention will become more readily understood when taken in connection with the appended claims and attached drawings in which the sole FIGURE is a sectional view of the gasket strip of the invention taken through plane normal to the glazing panels.

As illustrated in the drawing the gasket strip comprises an elongated elastomeric body 10 having parallel grooves 11 and 12 diametrically opposed on opposite sides thereof and running the length of the elongated body 10. Grooves 11 and 12 are adapted to receive the glazing panels 13. The wedge receiving groove 14 runs along the length of the elongated body 10 parallel to grooves 11 and 12 but on the side of body 10 substantially equidistant between oppositely disposed grooves 11 and 12. Since wedge-receiving groove 14 is substantially equidistant from grooves 11 and 12, the lips 11*a* and 12*a* of grooves 11 and 12 may be readily distended to allow insertion of panels 13 into grooves 11 and 12. Thereafter it is desirable that the lips 11 and 12 be rigidly urged against the panels 13 to securely maintain the panels within the grooves and to provide sealing between the panel and the gasket. Crowding of the lips 11*a* and 12*a* toward the panels 13 is accomplished by forcing wedge body 15 into the wedge-receiving groove 14. It will be observed that wedge strip 15 is also an elongated strip coextensive with the body 10 of the gasket. In cross section the wedge comprises a stem 16 and T-shaped head 17. The stem 16 is forced into the wedge-receiving groove 15 and thereby expands the groove 14 to urge the lips 11*a* and 12*a* toward the panels 13. It will be observed that by crowding the wedge stem 16 into the groove 14 the gasket body 10 becomes rigid and causes the grooves 11 and 12 to grippingly engage the panels 13.

As in conventional wedge-strengthened gaskets, the wedge strip 15 may be of less resilient material than the elastomeric material forming gasket body 10. Accordingly, insertion of the wedge substantially strengthens the gasket body and rigidly forces the lips 11*a* and 12*a* toward the panels 13.

The wedge 15 includes a T-head 17 extending laterally from the gasket body 10. The T-head has lips 17*a* and 17*b* extending laterally from the stem 16 in the direction of the panels 13. It will be observed that the lips 17*a* and 17*b* are positioned a finite distance from the body of the gasket body 10, thereby defining grooves 20 and 21 between lips 17*a* and 17*b* and the elongated gasket body 10.

In accordance with the invention a mounting mullion comprising oppositely disposed L-shaped members 22 and 23 are fitted within the grooves 21 and 22, respectively. It will thus be observed that the opposite disposed L-shaped members not only fit within the grooves 21 and 22 but grippingly engage the T-head 17 of the wedge 16. The L-shaped members are then secured together and to the wall-supporting structure by any convenient means such as by bolt 25 and serve as means for mounting the entire assembled panel at the desired location.

From the foregoing it will be observed that the panels 13 may be assembled within the grooves 11 and 12 before the gasket 10 is attached to the mullion. The expanding wedge 15 is then forced into the wedge-receiving groove 14 to completely assemble the wall panel and gasket before the wall panel assembly is erected and attached to the building structure. The assembled panel may then be placed as desired and the mounting mullions attached to T-head of the expanding wedge to mount the panel in the desired location. When assembled and mounted the expanding wedge is totally concealed.

It will be readily understood while the invention has been described with respect to mounting oppositely disposed panels in a single gasket the principle of the invention may be likewise applied to a gasket mounting supporting panels only on one side thereof. Likewise the particular shape of the expanding wedge 17 is disclosed for merely illustrative purposes. Various other shapes of mounting wedges may be used to accomplish similar results.

Although the invention has been described with particular reference to specific embodiments thereof it will be readily understood by those skilled in the art that various modifications and variations may be resorted to without departing from the spirit and scope of the invention as defined by the appended claims.

What is claimed is:

1. A curtain wall support including a gasket comprising:

a. an elongated elastomeric body having a first longitudinal groove disposed along one side thereof and a wedge-receiving recess disposed along another side thereof, the plane of said wedge-receiving recess being approximately normal to the plane of said first longitudinal groove; and b. wedge means adapted to mate with said wedge-receiving recess, said wedge means comprising an elongated body of T-shaped cross section, the base of said wedge means adapted to mate with said wedge-receiving recess and the head of said wedge means extending from the gasket body to define mounting grooves between the head of said wedge means and said elongated body, said mounting grooves adapted to mate with means for mounting and supporting said gasket, at least one of said mounting grooves paralleling said first longitudinal groove.

2. The curtain wall support defined in claim 1 including a second longitudinal groove disposed along one side of said body and substantially diametrically disposed from said first longitudinal groove.

3. The curtain wall support defined in claim 1 including mounting means adapted to mate with said mounting grooves and support said gasket body by the head of said wedge means.

4. The curtain wall support defined in claim 3 wherein said mounting means comprises a pair of oppositely disposed L-shaped members, the base of each L-shaped member mating with said mounting grooves and the legs of said L-shaped members enclosing the head of said wedge means.

5. Glazing gasket and support comprising;

a. an elongated elastomeric body having oppositely disposed longitudinal grooves adapted to receive glazing panels and a longitudinal recess traversing said body along one side thereof approximately equidistant from said grooves;

b. wedge means adapted to mate with said recess, said wedge means comprising an elongated body of T-shaped cross section, the base of said wedge means adapted to mate with said recess and the head thereof extending from said gasket body to define grooves between the head of said wedge means and said elongated body, said grooves paralleling said longitudinal grooves in said elastomeric body; and c. a mounting mullion comprising rigid parallel L-shaped bodies disposed on opposite sides of the head of said T-shaped wedge, the base of each L-shaped body mating with said grooves formed between the wedge and the elastomeric body.

* * * * *